US011248608B2

(12) United States Patent
Lee et al.

(10) Patent No.: US 11,248,608 B2
(45) Date of Patent: Feb. 15, 2022

(54) COMPRESSOR HAVING CENTRIFUGATION AND DIFFERENTIAL PRESSURE STRUCTURE FOR OIL SUPPLYING

(71) Applicant: LG ELECTRONICS INC., Seoul (KR)

(72) Inventors: Kangwook Lee, Seoul (KR); Taekyoung Kim, Seoul (KR); Cheol Hwan Kim, Seoul (KR); Byeongchul Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 51 days.

(21) Appl. No.: 16/692,112

(22) Filed: Nov. 22, 2019

(65) Prior Publication Data

US 2020/0088199 A1 Mar. 19, 2020

Related U.S. Application Data

(63) Continuation of application No. 15/830,135, filed on Dec. 4, 2017, now Pat. No. 10,781,817.

(30) Foreign Application Priority Data

Jun. 14, 2017 (KR) ..... 10-2017-0075041

(51) Int. Cl.
*F04C 29/02* (2006.01)
*F04C 18/02* (2006.01)
*F04C 23/00* (2006.01)

(52) U.S. Cl.
CPC ..... *F04C 29/02* (2013.01); *F04C 18/0215* (2013.01); *F04C 18/0292* (2013.01);
(Continued)

(58) Field of Classification Search
CPC ..... F04C 29/02; F04C 29/023; F04C 29/028; F04C 29/0057; F04C 18/0215; F04C 18/0292; F04C 23/008
See application file for complete search history.

(56) References Cited

U.S. PATENT DOCUMENTS 4,596,520 A 6/1986 Arata et al.
4,626,180 A 12/1986 Tagawa
(Continued)

FOREIGN PATENT DOCUMENTS

EP 0 913 581 5/1999
EP 1 526 283 4/2005
(Continued)

OTHER PUBLICATIONS

U.S. Notice of Allowance issued in U.S. Appl. No. 15/830,222 dated Jun. 18, 2020.
(Continued)

*Primary Examiner* — Deming Wan
(74) *Attorney, Agent, or Firm* — Ked & Associates LLP

(57) ABSTRACT

A scroll compressor is provided capable of supplying oil stored in an oil storage chamber upward through a rotary shaft to supply the oil to a compression device and to lubricate a bearing portion. The scroll compressor may include a casing, a drive motor, a rotary shaft, a main frame, a fixed scroll, and an orbiting scroll. A medium pressure chamber may be formed in or at a middle of the main frame, the fixed scroll, and the orbiting scroll. A pocket groove configured to guide oil discharged through the oil hole to the medium pressure chamber may be formed in an upper surface of the orbiting scroll, and a differential pressure path configured to guide the oil guided to the medium pressure chamber to the compression chamber may be provided in the fixed scroll.

17 Claims, 7 Drawing Sheets

(52) U.S. Cl.
CPC ..... *F04C 23/008* (2013.01); *F04C 29/023* (2013.01); *F04C 29/028* (2013.01); *F04C 2240/30* (2013.01); *F04C 2240/50* (2013.01); *F04C 2240/603* (2013.01)

(56) References Cited

U.S. PATENT DOCUMENTS

| | | | | |
|---|---|---|---|---|
| 4,768,936 | A | 9/1988 | Etemad | |
| 4,898,521 | A | 2/1990 | Sakurai | |
| 5,803,722 | A | 9/1998 | Noboru | |
| 6,030,192 | A | 2/2000 | Hill | |
| 6,273,691 | B1 | 8/2001 | Morimoto et al. | |
| 7,614,860 | B2 | 11/2009 | Yano | |
| 9,353,747 | B2 | 5/2016 | Ito | |
| 9,850,904 | B2 * | 12/2017 | Toyama | F04C 29/021 |
| 2009/0098000 | A1 | 4/2009 | Ignatiev | |
| 2010/0122549 | A1 | 5/2010 | Cho | |
| 2012/0148434 | A1 | 6/2012 | Takabe et al. | |
| 2013/0078131 | A1 | 3/2013 | Ahn et al. | |
| 2013/0343941 | A1 | 12/2013 | Kim et al. | |
| 2014/0140877 | A1 | 5/2014 | Ni | |
| 2014/0234148 | A1 | 8/2014 | Takeda | |
| 2016/0040671 | A1 | 2/2016 | Choi et al. | |
| 2016/0040673 | A1 * | 2/2016 | Lee | F04C 23/008 418/55.6 |
| 2016/0047378 | A1 | 2/2016 | Choi et al. | |
| 2016/0053759 | A1 | 2/2016 | Choi et al. | |
| 2016/0108917 | A1 | 4/2016 | Bonnefoi | |
| 2016/0341249 | A1 | 11/2016 | Yang | |

FOREIGN PATENT DOCUMENTS

| | | |
|---|---|---|
| EP | 2 369 182 | 9/2011 |
| EP | 2 574 791 | 4/2013 |
| EP | 2 690 287 | 1/2014 |
| EP | 3 401 543 | 11/2018 |
| JP | S 62-178791 | 8/1987 |
| JP | H 03-202682 | 9/1991 |
| JP | H 07-054784 | 2/1995 |
| JP | H 08-303364 | 11/1996 |
| JP | H 08-303365 | 11/1996 |
| JP | H 10-169574 | 6/1998 |
| JP | 2009-036069 | 2/2009 |
| JP | 2010-180704 | 8/2010 |
| JP | 5 199951 | 5/2013 |
| KR | 10-2011-0064663 | 6/2011 |
| KR | 10-1059880 | 8/2011 |
| KR | 10-2013-0034536 | 4/2013 |
| KR | 10-2016-0017539 | 2/2016 |
| WO | WO 97/17543 | 5/1997 |
| WO | WO 2014/198215 | 12/2014 |
| WO | WO 2015/085823 | 6/2015 |

OTHER PUBLICATIONS

European Search Report dated Apr. 26, 2018 issued in Application No. 17199214.2.
European Search Report dated May 4, 2018 issued in Application No. 17204354.9.
European Search Report dated May 17, 2018 issued in Application No. 17205582.4.
Korean Office Action dated Jul. 16, 2018 issued in Application No. 10-2017-0075041.
Korean Office Action dated Aug. 20, 2018.
European Search Report dated Sep. 7, 2018.
United States Office Action dated Oct. 31, 2019 issued in co-pending related U.S. Appl. No. 15/830,161.
U.S. Office Action dated Nov. 14, 2019 issued in U.S. Appl. No. 15/830,290.
European Office Action issued in Application No. 17 205 582.4 dated Dec. 10, 2020.
United States Office Action dated Jan. 14, 2020 issued in co-pending related U.S. Appl. No. 15/830,135.
U.S. Appl. No. 16/692,088, filed Nov. 22, 2019.
U.S. Appl. No. 16/914,726, filed Jun. 29, 2020.
U.S. Appl. No. 16/692,112, filed Nov. 22, 2019.
European Office Action dated Feb. 6, 2020.
U.S. Office Action dated Jan. 28, 2020 issued in co-pending related U.S. Appl. No. 15/830,222.
U.S. Office Action dated Nov. 19, 2020 issued in U.S. Appl. No. 16/692,088.
U.S. Office Action dated Apr. 30, 2020 issued in U.S. Appl. No. 15/830,290.
U.S. Appl. No. 15/830,135, filed Dec. 4, 2017.
U.S. Appl. No. 15/830,161, filed Dec. 4, 2017.
U.S. Appl. No. 15/830,184, filed Dec. 4, 2017.
U.S. Appl. No. 15/830,222, filed Dec. 4, 2017.
U.S. Appl. No. 15/830,248, filed Dec. 4, 2017.
U.S. Appl. No. 15/830,290, filed Dec. 4, 2017.
U.S. Notice of Allowance issued in U.S. Appl. No. 16/692,088 dated Mar. 31, 2021.
Korean Office Action issued in Application No. 10-2017-0079174 dated Jul. 12, 2021.

* cited by examiner

COMPRESSOR HAVING CENTRIFUGATION AND DIFFERENTIAL PRESSURE STRUCTURE FOR OIL SUPPLYING

CROSS-REFERENCE TO RELATED APPLICATIONS

This application is a Continuation Application of prior U.S. patent application Ser. No. 15/830,135 filed Dec. 4, 2017, which claims priority under 35 U.S.C. § 119 to Korean Application No. 10-2017-0075041 filed on Jun. 14, 2017, whose entire disclosures are hereby incorporated by reference.

BACKGROUND

1. Field

A compressor having a centrifugation and differential pressure structure for supplying oil is disclosed herein.

2. Background

Generally, a compressor is applied to a vapor compression type refrigeration cycle (hereinafter, referred to as a "refrigeration cycle") used for a refrigerator, or an air conditioner, for example. Compressors may be classified into reciprocating compressors, rotary compressors, and scroll compressors, for example, according to a method of compressing a refrigerant.

The scroll compressor among the above-described compressors is a compressor which performs an orbiting movement by engaging an orbiting scroll with a fixed scroll fixed inside of a sealed container so that a compression chamber is formed between a fixed wrap of the fixed scroll and an orbiting wrap of the orbiting scroll. The scroll compressor is widely used for compressing a refrigerant in an air conditioner, for example, because the scroll compressor can obtain a relatively higher compression ratio than the other types of compressors and can obtain a stable torque because suction, compression, and discharge strokes of the refrigerant are smooth and continuous.

Such scroll compressors may be classified into upper compression type compressors or lower compression type compressors according to a location of a drive motor and a compression component. The compression component is located at a higher level than the drive motor in the upper compression type compressor, and the compression component is located at a lower level than the drive motor in the lower compression type compressor.

In the lower compression type scroll compressor, as there is a short distance between an oil storage chamber and the compression component, oil may be relatively uniformly supplied thereto; however, it may be structurally difficult to supply the oil thereto. More particularly, in a lower compression type scroll compressor which is driven at various speeds from low to high speed, it is important to optimize performance and secure reliability of a bearing portion according to a flow rate of oil. Accordingly, a structural improvement for supplying oil is required for portions, such as a bearing surface or compression chamber, to which it is structurally difficult to supply oil.

BRIEF DESCRIPTION OF THE DRAWINGS

Embodiments will be described in detail with reference to the following drawings in which like reference numerals refer to like elements, and wherein.

DETAILED DESCRIPTION

Figure 1:
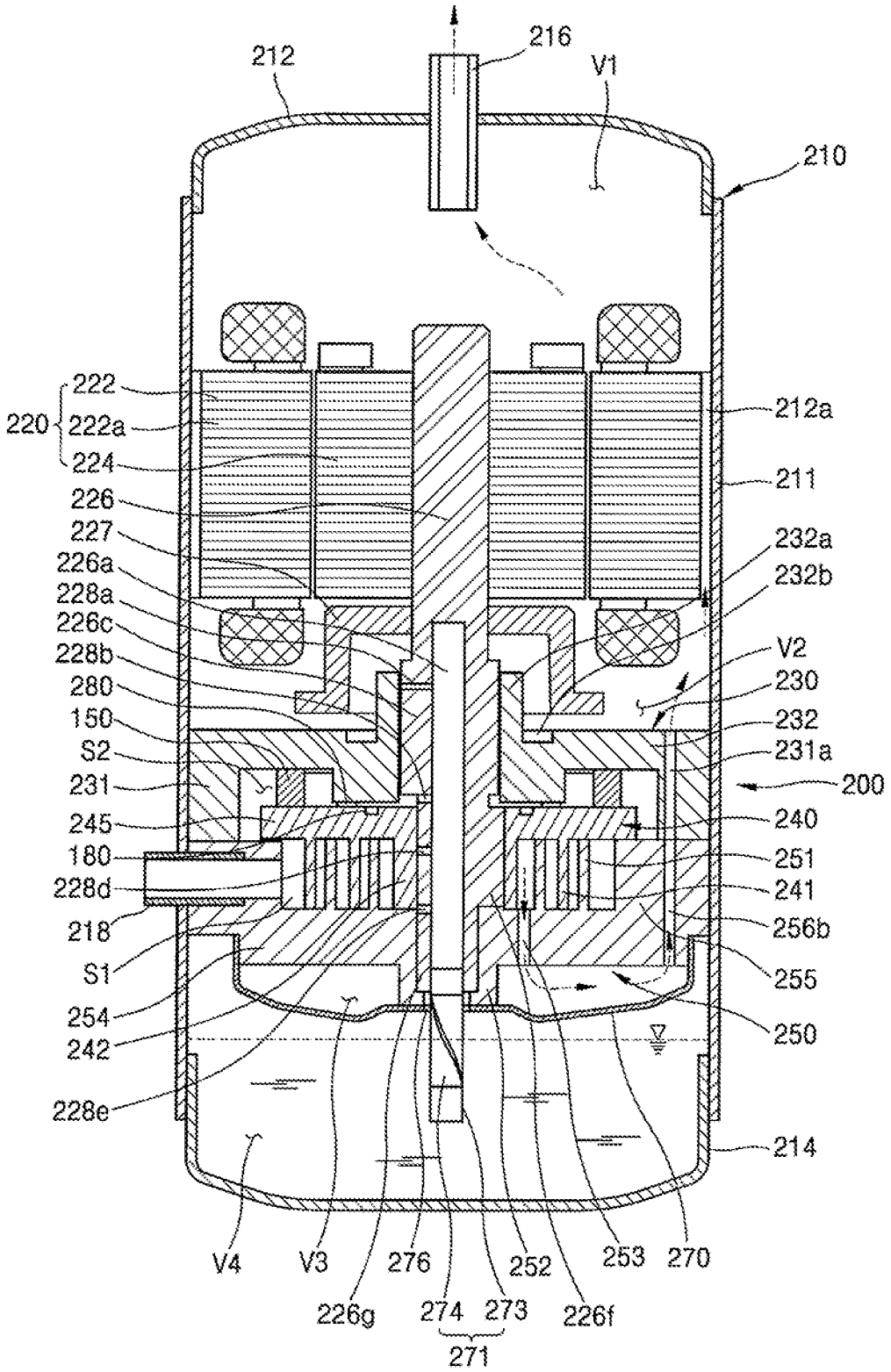
FIG. 1 is a cross-sectional view of a scroll compressor according to an embodiment.

Hereinafter, embodiments will be described with reference to accompanying drawings. Where possible, like or similar reference numerals in the drawings have been used to indicate like or similar elements, and repetitive disclosure has been omitted.

Hereinafter, a scroll compressor according to an embodiment will be described with reference to FIG. 1.

FIG. 1 is a cross-sectional view of a scroll compressor according to an embodiment. The scroll compressor according to an embodiment may include a casing 210 having an inner space, a drive motor 220 provided in an upper portion of the inner space, a compression part or device 200 disposed under the drive motor 220, and a rotary shaft 226 configured to transmit a drive force of the drive motor 220 to the compression device 200.

The inner space of the casing 210 may be divided into a first space V1, which may be provided at an upper side of the drive motor 220, a second space V2 between the drive motor 220 and the compression device 200, a third space V3 partitioned by a discharge cover 270, and an oil storage chamber V4, which may be provided under the compression device 200.

The casing 210, for example, may have a cylindrical shape, and thus, the casing 210 may include a cylindrical shell 211. An upper shell or cover 212 may be installed or provided on or at an upper portion of the cylindrical shell 211, and a lower shell or cover 214 may be installed or provided on or at a lower portion of the cylindrical shell 211. The upper and lower shells 212 and 214 may be coupled to the cylindrical shell 211 by welding, for example, and may form the inner space thereof.

A refrigerant discharge pipe 216 may be installed or provided in the upper shell 212. The refrigerant discharge pipe 216 may form a path through which a compressed refrigerant discharged from the compression device 200 into the second space V2 and the first space V1 may be discharged to the outside. An oil separator (not shown) configured to separate oil mixed with the discharged refrigerant may be connected to the refrigerant discharge pipe 216.

The lower shell 214 may form the oil storage chamber V4 capable of storing oil therein. The oil storage chamber V4 may serve as an oil chamber from which the oil may be supplied to the compression device 200 so that the compressor may be smoothly operated.

A refrigerant suction pipe 218, which may form a path through which a refrigerant to be compressed may be introduced, may be installed or provided in or at a side surface of the cylindrical shell 211. The refrigerant suction pipe 218 may be installed or provided to penetrate up to a compression chamber S1 along a side surface of a fixed scroll 250.

The drive motor 220 may be installed or provided in or at an upper portion inside of the casing 210. The drive motor 220 may include a stator 222 and a rotor 224.

The stator 222, for example, may have a cylindrical shape, and may be fixed to the casing 210. A plurality of slots (not shown) may be formed in an inner circumferential surface of the stator 222 in a circumferential direction, and a coil 222*a* may be wound on the stator 222. A refrigerant flow groove 212*a* may be cut in a D-cut shape and may be formed in an outer circumferential surface of the stator 222 so that a refrigerant or oil discharged from the compression device 200 may pass through the refrigerant flow groove 212*a*.

The rotor 224 may be coupled to an inside of the stator 222 and may generate rotational power. Also, the rotary shaft 226 may be press-fitted into a center of the rotor 224 so that the rotary shaft 226 may rotate with the rotor 224. The rotational power generated by the power rotor 224 may be transmitted to the compression device 200 through the rotary shaft 226.

The compression device 200 may include a main frame 230, the fixed scroll 250, an orbiting scroll 240, and the discharge cover 270. The compression device 200 may further include an Oldham's ring 150. The Oldham's ring 150 may be installed or provided between the orbiting scroll 240 and the main frame 230. The Oldham's ring 150 may prevent rotation of the orbiting scroll 240 and allow orbiting movement of the orbiting scroll 240 on the fixed scroll 250.

The main frame 230 may be provided under the drive motor 220 and may form an upper portion of the compression device 200. The main frame 230 may include a frame end plate (hereinafter, a "first end plate") 232 having a circular shape, a frame bearing section (hereinafter, a "first bearing section") 232*a*, which may be provided at a center of the first end plate 232 and through which the rotary shaft 226 may pass, and a frame sidewall (hereinafter, a "first sidewall") 231, which may protrude downward from an outer circumferential portion of the first end plate 232. An outer circumferential portion of the first sidewall 231 may be in contact with an inner circumferential surface of the cylindrical shell 211, and a lower end of the first sidewall 231 may be in contact with an upper end of a fixed scroll sidewall 255.

The first sidewall 231 may include a frame discharge hole (hereinafter, a "first discharge hole") 231*a*, which may pass through an inside of the first sidewall 231 in an axial direction and form a refrigerant path. An inlet of the first discharge hole 231*a* may communicate with an outlet of a fixed scroll discharge hole 256*b*, which will be described hereinafter, and an outlet of the first discharge hole 231*a* may communicate with the second space V2.

The first bearing section 232*a* may protrude from an upper surface of the first end plate 232 toward the drive motor 220. A first bearing portion may be formed at the first bearing section 232*a* so that a main bearing portion 226*c* of the rotary shaft 226, which will be described hereinafter, may pass therethrough and be supported by the first bearing portion. That is, the first bearing section 232*a*, into which the main bearing portion 226*c*, which forms the first bearing portion, of the rotary shaft 226 is rotatably inserted and by which the main bearing portion 226*c* is supported by the first bearing section 232*a*, may be formed at a center of the main frame 230 in the axial direction.

An oil pocket 232*b* configured to collect oil discharged from between the first bearing section 232*a* and the rotary shaft 226 may be formed in an upper surface of the first end plate 232. The oil pocket 232*b* may be formed by carving the upper surface of the first end plate 232 and may be formed in a circular shape along an outer circumferential surface of the first bearing section 232*a*. In addition, a back pressure chamber S2 may be formed in a lower surface of the main frame 230 to form a space with the fixed scroll 250 and the orbiting scroll 240 to support the orbiting scroll 240 using a pressure of the space.

The back pressure chamber S2 may include a medium pressure region, that is, a medium pressure chamber, and an oil supply path 226*a* provided in the rotary shaft 226 may include a high pressure region having a higher pressure than the back pressure chamber S2. A back pressure seal 280 may be provided between the main frame 230 and the orbiting scroll 240 to divide the high pressure region from the medium pressure region, and the back pressure seal 280 may serve as a sealing member.

In addition, the main frame 230 may be coupled to the fixed scroll 250 to form a space in which the orbiting scroll 240 may be rotatably installed or provided. That is, such a structure may be a structure which covers the rotary shaft 226 to transmit rotational power to the compression device 200 through the rotary shaft 226.

The fixed scroll 250 forming a first scroll may be coupled to a lower surface of the main frame 230. More specifically, the fixed scroll 250 may be provided below the main frame 230.

The fixed scroll 250 may include a fixed scroll end plate (a "second end plate") 254 having a substantially circular shape, a fixed scroll sidewall (hereinafter, a "second sidewall") 255 that protrudes upward from an outer circumferential portion of the second end plate 254, a fixed wrap 251 that protrudes from an upper surface of the second end plate 254 and is engaged with an orbiting wrap 241 of the orbiting scroll 240, which will be described hereinafter, to form the compression chamber S1, and a fixed scroll bearing section (hereinafter, a "second bearing section") 252 formed at a center of a rear surface of the second end plate 254 and through which the rotary shaft 226 may pass.

A discharge hole 253 configured to guide a compressed refrigerant from the compression chamber S1 to an inner space of the discharge cover 270 may be formed in the second end plate 254. In addition, a position of the discharge hole 253 may be arbitrarily determined in consideration of a required discharging pressure, for example.

As the discharge hole 253 is formed to face the lower shell 214, the discharge cover 270 for accommodating a discharged refrigerant and guiding the discharged refrigerant to the fixed scroll discharge hole 256*b*, which will be described hereinafter, in a state in which the discharged refrigerant is not mixed with oil, may be coupled to a lower surface of the fixed scroll 250. The discharge cover 270 may be hermetically coupled to a lower surface of the fixed scroll 250 to separate a discharge path of the refrigerant from the oil storage chamber V4. In addition, a through hole 276 may be formed in the discharge cover 270 so that an oil feeder 271 coupled to a sub-bearing portion 226*g*, which forms a second bearing portion and is submerged in the oil storage chamber V4 of the casing 210, of the rotary shaft 226 may pass through the through hole 276.

The second sidewall 255 may include a fixed scroll discharge hole (hereinafter, a "second discharge hole") 256*b* that passes through an inside of the second sidewall 255 in the axial direction and forms a refrigerant path with the first discharge hole 231*a*. The second discharge hole 256*b* may be formed to correspond to the first discharge hole 231*a*, an inlet of the second discharge hole 256*b* may communicate with the inner space of the discharging cover 270, and an outlet of the second discharge hole 256*b* may communicate with the inlet of the first discharge hole 231*a*.

The third space V3 may communicate with the second space V2 using the second discharge hole 256*b* and the first discharge hole 231*a* to guide a refrigerant, which is discharged from the compression chamber S1 to the inner space of the discharge cover 270, to the second space V2. In addition, the refrigerant suction pipe 218 may be installed or provided in the second sidewall 255 to communicate with a suction side of the compression chamber S1. The refrigerant suction pipe 218 may be spaced apart from the second discharge hole 256*b*.

The second bearing section 252 may protrude from a lower surface of the second end plate 254 toward the oil storage chamber V4. The second bearing section 252 may include the second bearing portion so that the sub-bearing portion 226*g* of the rotary shaft 226 may be inserted into and supported by the second bearing portion. A lower end of the second bearing section 252 may be bent toward a center of the shaft to support a lower end of the sub-bearing portion 226*g* of the rotary shaft 226 to form a thrust bearing surface.

The orbiting scroll 240 forming a second scroll may be installed or provided between the main frame 230 and the fixed scroll 250. More specifically, the orbiting scroll 240 may be coupled to the rotary shaft 226, to perform an orbiting movement and form two compression chambers S1, that is, a pair of compression chambers S1, between the orbiting scroll 240 and the fixed scroll 250.

The orbiting scroll 240 may include an orbiting scroll end plate (hereinafter, a "third end plate") 245 having a substantially circular shape, the orbiting wrap 241 which protrudes from a lower surface of the third end plate 245 and is engaged with the fixed wrap 251, and a rotary shaft coupler 242 provided at a center of the third end plate 245 and rotatably coupled to an eccentric portion 226*f* of the rotary shaft 226. In the orbiting scroll 240, an outer circumferential portion of the third end plate 245 may be located at an upper end of the second sidewall 255, and a lower end of the orbiting wrap 241 may be pressed against an upper surface of the second end plate 254 so that the orbiting scroll 240 may be supported by the fixed scroll 250.

A pocket groove 180 to guide oil discharged through oil holes 228*a*, 228*b*, 228*d*, and 228*e*, which will be described hereinafter, to the medium pressure chamber may be formed in an upper surface of the orbiting scroll 240. More specifically, the pocket groove 180 may be formed by carving an upper surface of the third end plate 245. That is, the pocket groove 180 may be formed in the upper surface of the third end plate 245 between the back pressure seal 280 and the rotary shaft 226.

As illustrated in the drawing, one pocket groove 180 may be formed at each of both sides of the rotary shaft 226; however, a plurality of pocket grooves 180 may also be formed at each of both sides of the rotary shaft 226. When the plurality of pocket grooves 180 is formed, the plurality of pocket grooves may be spaced a predetermined distance from each other on the upper surface of the third end plate 245 between the back pressure seal 280 and the rotary shaft 226. The pocket groove 180 may also be formed around the rotary shaft 226 in a circular shape on the upper surface of the third end plate 245 between the back pressure seal 280 and the rotary shaft 226.

An outer circumferential portion of the rotary shaft coupler 242 may be connected to the orbiting wrap 241 to form the compression chamber S1 with the fixed wrap 251 during a compression process. The fixed wrap 251 and the orbiting wrap 241 may be formed in an involute shape, but may also be formed in any of various shapes other than the involute shape. The term "involute shape" refers to a curved line corresponding to a trajectory drawn by an end of a thread when the thread wound around a base circle having an arbitrary radius is released.

The eccentric portion 226*f* of the rotary shaft 226 may be inserted into the rotary shaft coupler 242. The eccentric portion 226*f* inserted into the rotary shaft coupler 242 may overlap the orbiting wrap 241 or the fixed wrap 251 in a radial direction of the compressor.

The term "radial direction" may refer to a direction, that is, a lateral direction, perpendicular to an axial direction, that is, a vertical direction. More specifically, the radial direction may refer to a direction from an outside of the rotary shaft to an inside thereof.

As described above, when the eccentric portion 226*f* of the rotary shaft 226 passes through the third end plate 245 and overlaps the orbiting wrap 241 in the radial direction, a repulsive force and a compressive force of a refrigerant may be applied to a same plane based on the third end plate 245 to be partially canceled. In addition, the rotary shaft 226 may be coupled to the drive motor 220 and include the oil supply path 226*a* to guide the oil stored in the oil storage chamber V4 of the casing 210 upward. More specifically, an upper portion of the rotary shaft 226 may be press-fitted into and coupled to a center of the rotor 224, and a lower portion of the rotary shaft 226 may be coupled to the compression device 200 and supported in the radial direction by the compression device 200.

Accordingly, the rotary shaft 226 may transmit a rotational force of the drive motor 220 to the orbiting scroll 240 of the compression device 200. In addition, the orbiting scroll 240 eccentrically coupled to the rotary shaft 226 may perform an orbiting movement with respect to the fixed scroll 250 using the transmitted rotational force.

A main bearing portion 226*c* may be formed at a lower portion of the rotary shaft 226 to be inserted into the first bearing section 232*a* of the main frame 230 and supported in a radial direction by the first bearing section 232*a*. In addition, the sub-bearing portion 226*g* may be formed under the main bearing portion 226*c* to be inserted into the second bearing section 252 of the fixed scroll 250 and supported in the radial direction by the second bearing section 252. In addition, the eccentric portion 226*f* may be formed between the main bearing portion 226*c* and the sub-bearing portion 226*g* to be inserted into and coupled to the rotary shaft coupler 242 of the orbiting scroll 240.

The main bearing portion 226*c* and the sub-bearing portion 226*g* may be coaxially formed to have a same axial center, and the eccentric portion 226*f* may be eccentrically formed in the radial direction with respect to the main bearing portion 226*c* or the sub-bearing portion 226*g*. For example, the eccentric portion 226*f* may have an outer diameter smaller than an outer diameter of the main bearing portion 226*c* and larger than an outer diameter of the sub-bearing portion 226*g*. In this case, the rotary shaft 226 may have an advantage in that the rotary shaft 226 may pass through and be coupled to the bearing sections 232*a* and 252 and the rotary shaft coupler 242.

Conversely, the eccentric portion 226*f* may not be formed integrally with the rotary shaft 226 but may be formed using a separate bearing. In this case, even when the sub-bearing portion 226*g* is not formed to have an outer diameter which is smaller than an outer diameter of the eccentric portion 226*f*, the rotary shaft 226 may be inserted into and coupled to the bearing sections 232*a* and 252 and the rotary shaft coupler 242.

The oil supply path 226*a* to supply the oil of the oil storage chamber V4 to circumferential surfaces of the bearing portions 226*c* and 226*g* and a circumferential surface of the eccentric portion 226*f* may be formed in the rotary shaft 226. In addition, the oil holes 228*a*, 228*b*, 228*d*, and 228*e* which may pass from the oil supply path 226*a* to the outer circumferential surface thereof may be formed in the bearing portions and eccentric portion 226*c*, 226*g*, and 226*f* of the rotary shaft 226. More specifically, the oil holes may include a first oil hole 228*a*, a second oil hole 228*b*, a third oil hole 228*d*, and a fourth oil hole 228*e*.

The first oil hole 228*a* may pass through an outer circumferential surface of the main bearing portion 226*c*. More specifically, the first oil hole 228*a* may pass from the oil supply path 226*a* to an outer circumferential surface of the main bearing portion 226*c*.

In addition, the first oil hole 228*a* may pass through, for example, an upper portion of the outer circumferential surface of the main bearing portion 226*c*; however, embodiments are not limited thereto. That is, the first oil hole 228*a* may pass through a lower portion of the outer circumferential surface of the main bearing portion 226*c*.

Unlike the drawing, a plurality of first oil holes 228*a* may be formed. In addition, when the plurality of first oil holes 228*a* is formed, the holes may be formed in only the upper or lower portion of the outer circumferential surface of the main bearing portion 226*c* or formed in both of the upper and lower portions of the outer circumferential surface of the main bearing portion 226*c*. However, in this embodiment, one first oil hole 228*a* is shown for sake of convenience of description.

A first oil groove 229*a* (see FIG. 2), which may be obliquely or spirally formed and have a first end connected to the first oil hole 228*a*, may be formed in the outer circumferential surface of the main bearing portion 226*c*. More specifically, as the first end of the first oil groove 229*a* (see FIG. 2) is formed to be connected to the first oil hole 228*a*, some oil discharged from the first oil hole 228*a* may be efficiently supplied to the outer circumferential surface of the main bearing portion 226*c* via the first oil groove 229*a* (see FIG. 2). That is, some of the oil discharged from the first oil hole 228*a* may flow through the first oil groove 229*a* (see FIG. 2) and be supplied to upper, lower, and lateral sides of the outer circumferential surface of the main bearing portion 226*c*. The remaining oil discharged from the first oil hole 228*a* may be directly supplied to the upper, lower, and lateral sides of the outer circumferential surface of the main bearing portion 226*c* around the first oil hole 228*a*. The first oil groove 229*a* (see FIG. 2) may be obliquely formed in a direction or an opposite direction of rotation of the rotary shaft 226. That is, the first oil groove 229*a* (see FIG. 2) may obliquely extend between the axial direction and the rotational direction (or the opposite direction of rotation) of the rotary shaft 226.

Unlike the drawing, a plurality of first oil grooves 229*a* (see FIG. 2) may be formed. For example, when the plurality of first oil grooves 229*a* (see FIG. 2) is formed, and one first oil hole 228*a* is formed, one end of each of the grooves may be connected to the first oil hole 228*a*.

In addition, when the plurality of first oil grooves 229*a* (see FIG. 2) is formed and the plurality of first oil holes 228*a* is also formed, one end of each of the grooves may be connected to the holes one to one. However, in this embodiment, the first oil groove 229*a* (see FIG. 2) including one groove is shown for the sake of convenience of description.

The second oil hole 228*b* may be formed between the main bearing portion 226*c* and the eccentric portion 226*f*. More specifically, the second oil hole 228*b* may be formed in a first small diameter portion 54 by which the main bearing portion 226*c* and the eccentric portion 226*f* are spaced a predetermined distance from each other. That is, the second oil hole 228*b* may pass from the oil supply path 226*a* to an outer circumferential surface of the first small diameter portion 54.

The first small diameter portion 54 may be provided to secure processability for forming the main bearing portion 226*c* and the eccentric portion 226*f* in a grinding process. In addition, the first small diameter portion 54 may also be provided to secure a damping space for continuously supplying oil guided upward through the rotary shaft 226.

Unlike the drawing, a plurality of second oil holes 228*b* may be formed. In addition, when the plurality of second oil holes 228*b* is formed, the holes may be spaced a predetermined distance from each other in the first small diameter portion 54. However, in this embodiment, one second oil hole 228*b* is shown for sake of convenience of description.

The third oil hole 228*d* may pass through an outer circumferential surface of the eccentric portion 226*f*. More specifically, the third oil hole 228*d* may pass from the oil supply path 226*a* to the outer circumferential surface of the eccentric portion 226*f*. In addition, the third oil hole 228*d* may pass through, for example, a central portion of the outer circumferential surface of the eccentric portion 226*f*; however, embodiments are not limited thereto. That is, the third oil hole 228*d* may also pass through an upper or lower portion of the outer circumferential surface of the eccentric portion 226*f*.

Unlike the drawing, a plurality third oil holes 228*d* may be formed. In addition, when the plurality of third oil holes 228*d* is formed, the holes may be formed only in a middle region of the outer circumferential surface of the eccentric portion 226*f* or formed at both of the upper and lower portions of the outer circumferential surface of the eccentric portion 226*f*. However, in this embodiment, one third oil hole 228*d* is shown for sake of convenience of description.

A second oil groove 229*b* (see FIG. 2) may be formed in the outer circumferential surface of the eccentric portion 226*f* to be connected to the third oil hole 228*d* and perpendicularly extend therefrom. More specifically, as the third oil hole 228*d* is formed at a central portion of the second oil groove 229*b* (see FIG. 2), some oil discharged from the third oil hole 228*d* may be efficiently supplied to the outer circumferential surface of the eccentric portion 226*f* via the second oil groove 229*b* (see FIG. 2). That is, some of the oil discharged from the third oil hole 228*d* may flow through the second oil groove 229*b* (see FIG. 2) and be supplied to upper, lower, and lateral sides of the outer circumferential surface of the eccentric portion 226*f*. The remaining oil discharged from the third oil hole 228*d* may be directly supplied to the upper, lower, and lateral sides of the outer circumferential surface of the eccentric portion 226*d* around the third oil hole 228*d*.

Figure 2:
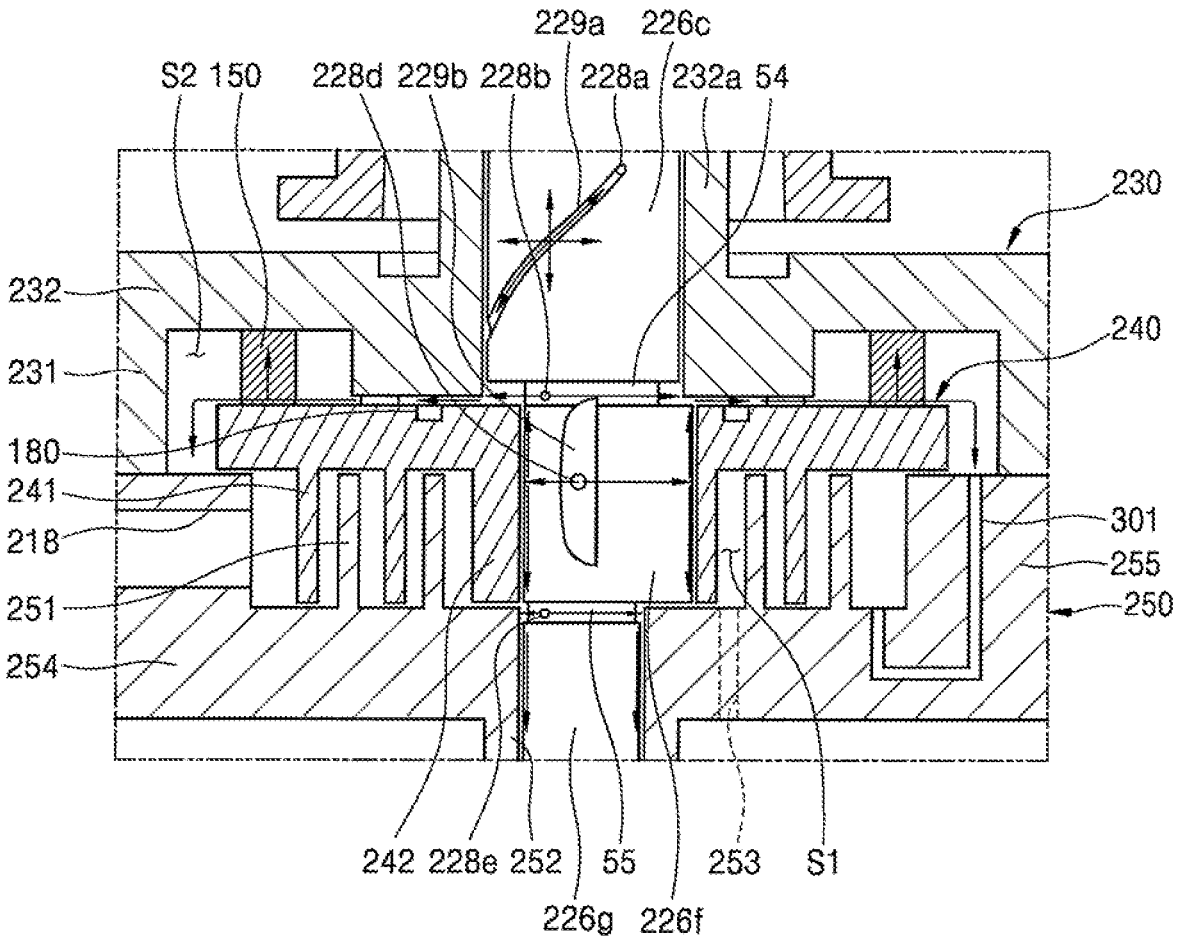
FIGS. 2 and 3 are schematic views of a structure for supplying oil of the scroll compressor of FIG. 1 according to an embodiment.

However, the third oil hole 228*d* may also be formed in an upper or lower portion of the second oil groove 229*b* (see FIG. 2). In addition, the second oil groove 229*b* (see FIG. 2) may extend straight in a vertical or longitudinal direction, as illustrated in the drawing, but may also be obliquely or spirally formed in the longitudinal direction in some cases.

Unlike the drawing, a plurality of second oil grooves 229*b* (see FIG. 2) may be formed. For example, when the plurality of second oil grooves 229*b* (see FIG. 2) is formed, the plurality of third oil holes 228*d* may also be formed, and a hole may also be formed in a central portion of each of the grooves. However, in this embodiment, one second oil groove 229*b* (see FIG. 2) is shown for sake of convenience of description.

Lastly, the fourth oil hole 228*e* may be formed between the eccentric portion 226*f* and the sub-bearing portion 226*g*. More specifically, the fourth oil hole 228*e* may be formed in a second small diameter portion 55 by which the eccentric portion 226*f* and the sub-bearing portion 226*g* are spaced a predetermined distance from each other. That is, the fourth oil hole 228*e* may pass from the oil supply path 226*a* to an outer circumferential surface of the second small diameter portion 55.

The second small diameter portion 55 may be provided to secure processability for forming the eccentric portion 226*f* and the sub-bearing portion 226*g* in a grinding process. In addition, the second small diameter portion 55 may also secure a damping space for continuously supplying oil guided upward through the rotary shaft 226.

Unlike the drawing, a plurality of fourth oil holes 226*e* may be formed. In addition, when the plurality of fourth oil holes 226*e* is formed, the holes may be spaced a predetermined distance from each other in the second small diameter portion 55. However, in this embodiment, one fourth oil hole 226*e* is shown for sake of convenience of description.

Thus, oil guided upward through the oil supply path 226*a* may be discharged through the first oil hole 228*a* and supplied to the entire outer circumferential surface of the main bearing portion 226*c*. In addition, the oil guided upward through the oil supply path 226*a* may be discharged through the second oil hole 228*b* to be supplied to the upper surface of the orbiting scroll 240, and discharged through the third oil hole 228*d* to be supplied to the entire outer circumferential surface of the eccentric portion 226*f*. The oil guided upward through the oil supply path 226*a* may be discharged through the fourth oil hole 228*e* and supplied to the outer circumferential surface of the sub-bearing portion 226*g* or supplied between the orbiting scroll 240 and the fixed scroll 250.

Additional oil holes (not shown) may pass from the oil supply path 226*a* to the outer circumferential surface of the sub-bearing portion 226*g*. In addition, oil discharged through the additional oil holes may also be supplied to the entire outer circumferential surface of the sub-bearing portion 226*g*.

The oil feeder 271 that pumps oil from the oil storage chamber V4 may be coupled to a lower end of the rotary shaft 226, that is, a lower end of the sub-bearing portion 226*g*. The oil feeder 271 may be formed with an oil supply pipe 273 inserted into and coupled to the oil supply path 226*a* of the rotary shaft 226, and an oil suction pump 274 inserted into the oil supply pipe 273 and configured to suction oil. The oil supply pipe 273 may be installed or provided to pass through the through hole 276 of the discharge cover 270 and be submerged in the oil storage chamber V4, and the oil suction pump 274 may function like a propeller.

Although not illustrated in the drawing, a trochoid pump (not shown) may be coupled to the sub-bearing portion 226*g* instead of the oil feeder 271 to forcibly pump the oil contained in the oil storage chamber V4. Further, although not illustrated in the drawing, the scroll compressor according to an embodiment may further include a first sealing member or seal (not shown) that seals a gap between an upper end of the main bearing portion 226*c* and an upper end of the main frame 230, and a second sealing member or seal (not shown) that seals a gap between a lower end of the sub-bearing portion 226*g* and a lower end of the fixed scroll 250. Leakage of oil to an outside of the compression device 200 along a bearing surface, that is, an outer circumferential surface of a bearing portion, may be prevented by the first and second sealing members or seals to realize a differential pressure structure for supplying oil and prevent backflow of a refrigerant.

A balance weight 227 that suppresses noise and vibration may be coupled to the rotor 224 or the rotary shaft 226. The balance weight 227 may be provided between the drive motor 220 and the compression device 200, that is, in the second space V2.

An operation process of the scroll compressor according to an embodiment will be described hereinafter.

When power is applied to the drive motor 220 and a rotational force is generated, the rotary shaft 226 coupled to the rotor 224 of the drive motor 220 is rotated. Accordingly, the orbiting scroll 240 eccentrically coupled to the rotary shaft 226 may perform an orbiting movement with respect to the fixed scroll 250 and form the compression chamber S1 between the orbiting wrap 241 and the fixed wrap 251. The compression chamber S1 may be continuously formed in several steps such that a volume thereof gradually decreases toward a center thereof.

Then, a refrigerant supplied from outside of the casing 210 through the refrigerant suction pipe 218 may directly flow into the compression chamber S1. The refrigerant may be compressed while being moved toward a discharge chamber of the compression chamber S1 by the orbiting movement of the orbiting scroll 240 to be discharged from the discharge chamber to the third space V3 through the discharge hole 253 of the fixed scroll 250. Next, a series of processes in which the compressed refrigerant discharged to the third space V3 is discharged to the inner space of the casing 210 through the second discharge hole 256*b* and the first discharge hole 231*a*, and is discharged to the outside of the casing 210 through the refrigerant discharge pipe 216 may be repeated.

Hereinafter, a structure for supplying oil of the scroll compressor of FIG. 1 according to an embodiment will be described with reference to FIGS. 2 and 3.

Figure 3:
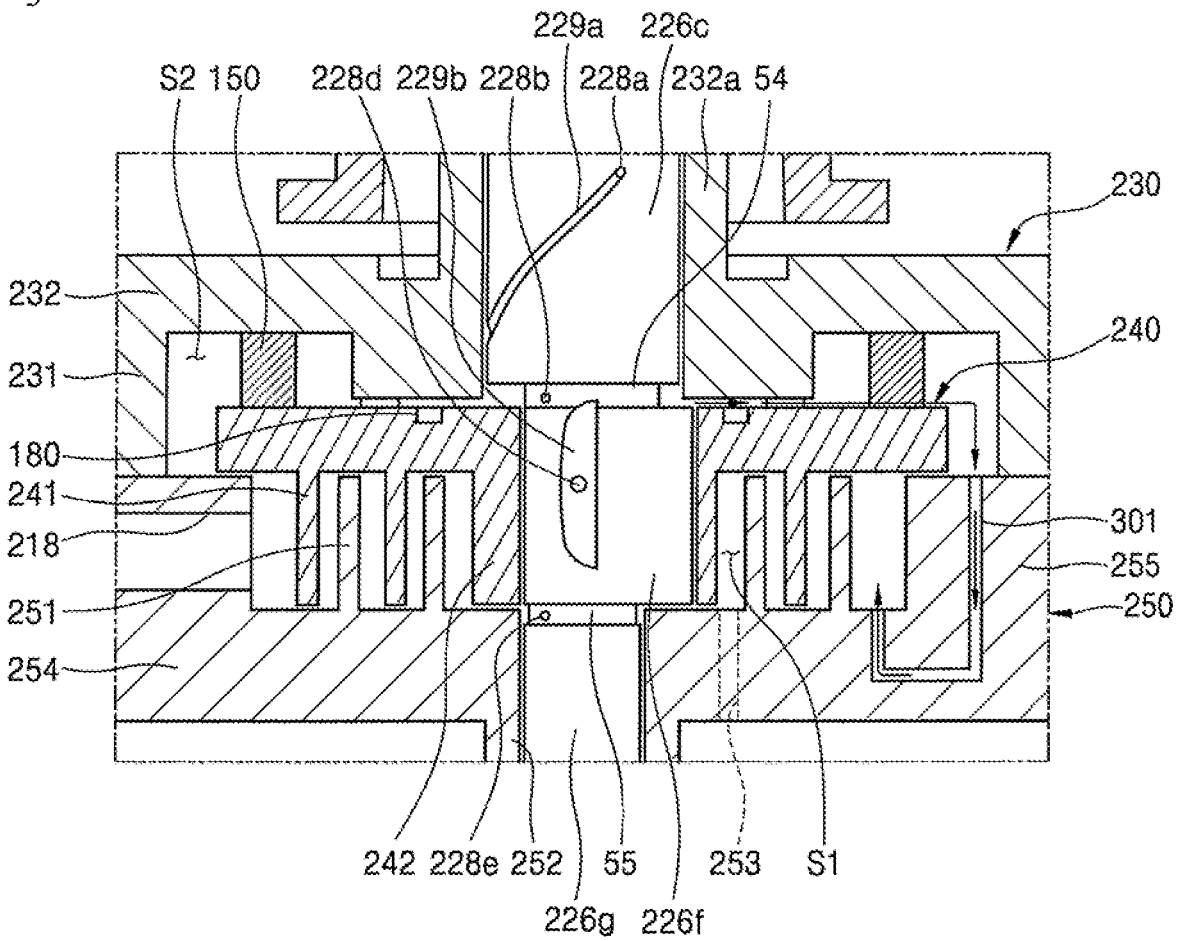

FIGS. 2 and 3 are schematic views of a structure for supplying oil of the scroll compressor of FIG. 1 according to an embodiment. An oil flow according to a centrifugation structure for supplying oil is illustrated in FIG. 2, and an oil flow according to a differential pressure structure for supplying oil is illustrated in FIG. 3. More specifically, oil stored in the oil storage chamber V4 (see FIG. 1) may be guided, that is, moved or supplied, upward through the oil supply path 226*a* (see FIG. 1) of the rotary shaft 226.

As illustrated in FIG. 2, the oil guided upward through the oil supply path 226*a* (see FIG. 1) may be discharged through the first oil hole 228*a* and supplied to the entire outer circumferential surface of the main bearing portion 226*c*. The oil guided upward through the oil supply path 226*a* (see FIG. 1) may be discharged through the second oil hole 228*b* and supplied to the upper surface of the orbiting scroll 240, that is, the upper surface of the third end plate 245 (see FIG. 1). The oil guided upward through the oil supply path 226*a* (see FIG. 1) may be discharged through the third oil hole 228*d* and supplied to the entire outer circumferential surface of the eccentric portion 226*f*. The oil guided upward through the oil supply path 226*a* (see FIG. 1) may be discharged through the fourth oil hole 228*e* and supplied to the outer circumferential surface of the sub-bearing portion 226*g* or supplied between the orbiting scroll 240 and the fixed scroll 250.

As described above, the oil stored in the oil storage chamber V4 may be guided upward through the rotary shaft 226 and easily supplied to the bearing portion, that is, the bearing surface, through the plurality of oil holes 228*a*, 228*b*, 228*d*, and 228*e* so that wear of the bearing portion may be prevented. The oil discharged through the plurality of oil holes 228*a*, 228*b*, 228*d*, and 228*e* may form an oil film between the fixed scroll 250 and the orbiting scroll 240 to maintain a hermetic state therebetween. The oil discharged through the plurality of oil holes 228*a*, 228*b*, 228*d*, and 228*e* may also absorb frictional heat generated by friction to dissipate heat from the high temperature compression device 200.

The oil guided upward through the oil supply path 226*a* (see FIG. 1) may be discharged through an oil hole, for example, the second oil hole 228*b*, and supplied to the upper surface of the orbiting scroll 240. In addition, the oil supplied to the upper surface of the orbiting scroll 240 may be guided to the medium pressure chamber S2 through the pocket groove 180.

That is, as illustrated in FIG. 3, the oil guided upward through the oil supply path 226*a* (see FIG. 1) may be discharged through an oil hole, for example, the second oil hole 228*b*, and guided to the pocket groove 180. The oil guided to the pocket groove 180 may be supplied to the medium pressure chamber S2 by the orbiting movement of the orbiting scroll 240. Oil discharged through the second oil hole 228*b* and the first oil hole 228*a* or the third oil hole 228*d* may also be supplied to the pocket groove 180.

The oil guided to the medium pressure chamber S2 may be supplied to a thrust surface of the fixed scroll 250 and the Oldham's ring 150 installed between the orbiting scroll 240 and the main frame 230. That is, the oil that flows into the medium pressure chamber S2 may be sufficiently supplied to the thrust surface of the fixed scroll 250 and the Oldham's ring 150. Accordingly, wear of the thrust surface of the fixed scroll 250 and the Oldham's ring 150 may be reduced.

The oil guided to the medium pressure chamber S2 may be guided to a differential pressure path 301 that supplies oil included in the fixed scroll 250. More specifically, the fixed scroll 250 of the scroll compressor of FIG. 1 may further include the differential pressure path 301 which guides the oil guided to the medium pressure chamber S2 to the compression chamber S1.

The differential pressure path 301 may pass through the second sidewall 255 and the second end plate 254; however, embodiments are not limited thereto. That is, the differential pressure path 301 may pass through only the second sidewall 255. In this case, the differential pressure path 301 may have a shorter length than the differential pressure path 301 which passes through both the second sidewall 255 and the second end plate 254.

One or a first end of the differential pressure path 301 may communicate with the medium pressure chamber S2, and the other or a second end of the differential pressure path 301 may communicate with the compression chamber S1. Accordingly, oil guided to the differential pressure path 301 may be supplied to the compression chamber S1.

As described above, the oil stored in the oil storage chamber V4 may be easily supplied to the compression chamber S1 through the pocket groove 180 and the differential pressure path 301. As oil is easily supplied to the compression chamber S1, wear due to friction between the orbiting scroll 240 and the fixed scroll 250 may be reduced so that compression efficiency may be improved.

The oil supplied to the compression chamber S1 may form an oil film between the fixed scroll 250 and the orbiting scroll 240 to maintain a hermetic state therebetween. Further, the oil supplied to the compression chamber S1 may also absorb frictional heat generated by friction between the fixed scroll 250 and the orbiting scroll 240 to dissipate the heat.

Hereinafter, structure for supplying oil of the scroll compressor of FIG. 1 according to another embodiment will be described with reference to FIGS. 4 and 5.

Figure 4:
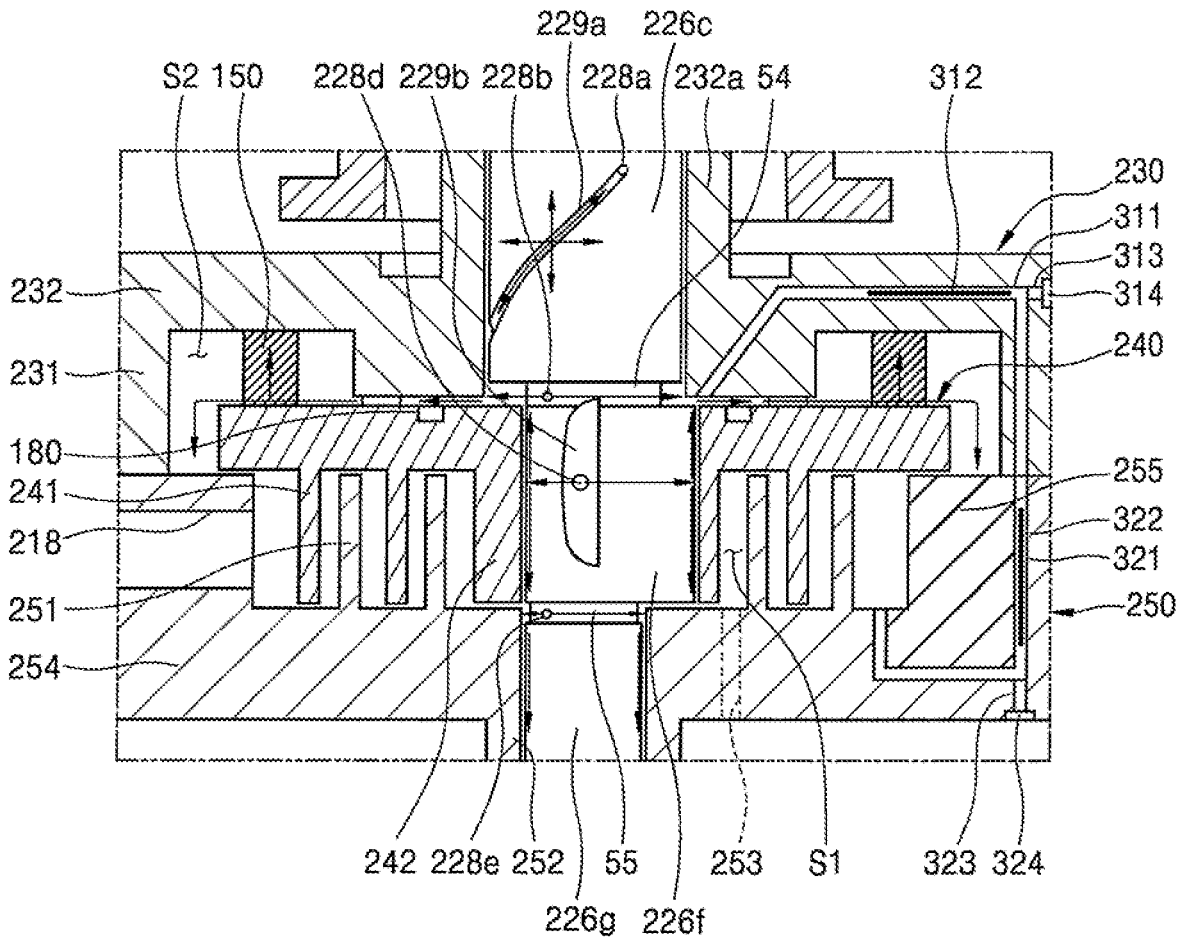
FIGS. 4 and 5 are schematic views of a structure for supplying oil of the scroll compressor of FIG. 1 according to another embodiment.
Figure 5:
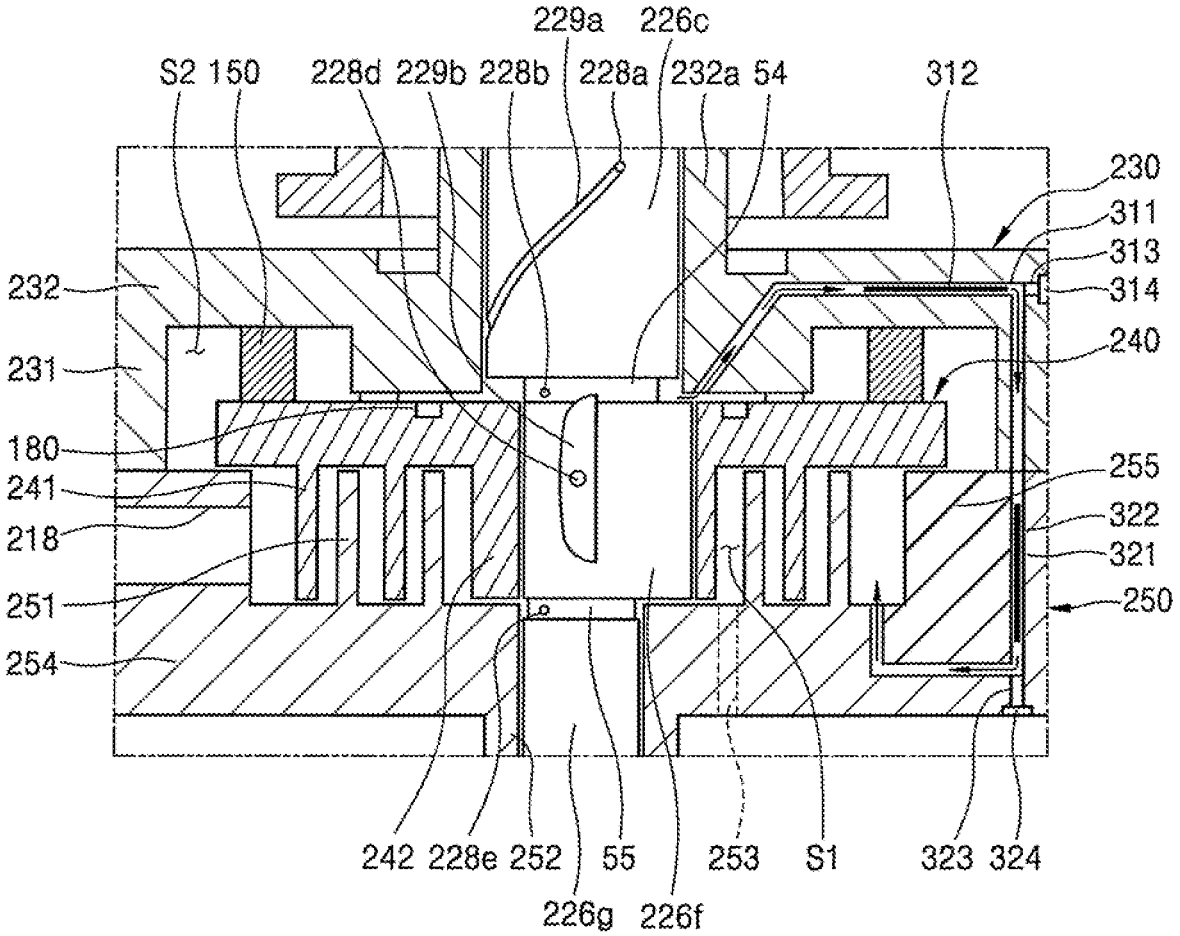

FIGS. 4 and 5 are schematic views of a structure for supplying oil of the scroll compressor of FIG. 1 according to another embodiment. An oil flow according to a centrifugation structure for supplying oil is illustrated in FIG. 4, and an oil flow according to a differential pressure structure for supplying oil is illustrated in FIG. 5. However, as the oil flow according to the centrifugation structure for supplying oil and the pocket groove 180 illustrated in FIG. 4 may be the same as that of the previous embodiment illustrated in FIG. 2, repetitive description thereof has been omitted.

The main frame 230 of the scroll compressor of FIG. 1 may further include a first differential pressure path 311 configured to receive oil discharged through an oil hole, for example, the second oil hole 228*b*. Oil discharged through the second oil hole 228*b* and the first oil hole 228*a* or third oil hole 228*d* may also be supplied to the first differential pressure path 311.

The first differential pressure path 311 may bypass the medium pressure chamber S2, that is, pass through the first end plate 232 and the first sidewall 231. That is, one or a first end of the first differential pressure path 311 may be connected to a high-pressure region to receive oil and the other or a second end of the first differential pressure path 311 may be connected to one or a first end of a second differential pressure path 321. The high-pressure region may refer to a region between the first small diameter portion 54 and the first end of the first differential pressure path 311.

The fixed scroll 250 may further include the second differential pressure path 321 to guide oil received from the first differential pressure path 311 to the compression chamber S1. The second differential pressure path 321 may pass through the second sidewall 255 and the second end plate 254. That is, the first end of the second differential pressure path 321 may be connected to the second end of the first differential pressure path 311 and the other or a second end of the second differential pressure path 321 may be connected to the compression chamber S1.

The main frame 230 may further include a first opening 314, which opens a portion of the first differential pressure path 311 at a side surface of the first end plate 232, and a first coupling member 313, which seals the first opening 314. The fixed scroll 250 may further include a second opening 324, which opens a portion of the second differential pressure path 321 at a lower surface of the second end plate 254, and a second coupling member 323, which seals the second opening 324.

Each of the first coupling member 313 and the second coupling member 323 may be one of, for example, a bolt (when a fastening method is applied), a rod (when a press-fitting method is applied), and a ball (when a press-fitting method is applied); however, embodiments are not limited thereto.

In addition, the first opening 314 may be used to insert a first decompression pin 312 into the first differential pressure path 311, and the second opening 324 may be used to insert a second decompression pin 322 into the second differential pressure path 321. When the first and second decompression pins 312 and 322 are respectively inserted into the first and second differential pressure paths 311 and 321, the first and second coupling members 313 and 323 may be respectively coupled to the first and second openings 314 and 324. That is, as the first coupling member 313 and the second coupling member 323 are respectively coupled to the first opening 314 and the second opening 324, pressures in the first differential pressure path 311 and the second differential pressure path 321 may be maintained.

In addition, the first decompression pin 312 may be provided in the first differential pressure path 311, and the second decompression pin 322 may be provided in the second differential pressure path 321. A diameter of the first decompression pin 312 may be smaller than a diameter of the first differential pressure path 311, and a diameter of the second decompression pin 322 may be smaller than a diameter of the second differential pressure path 321. In this way, the first decompression pin 312 may form a narrow path in the first differential pressure path 311 through which oil may flow so that a pressure and a flow rate of oil in the first differential pressure path 311 may be adjusted. In addition, the second decompression pin 322 may form a narrow path in the second differential pressure path 321 through which oil may flow so that a pressure and a flow rate of oil in the second differential pressure path 321 may be adjusted.

A decompression pin may also be provided in only one of the first differential pressure path 311 or the second differential pressure path 321. However, in this embodiment, a decompression pin is shown as being provided in each of the first differential pressure path 311 and the second differential pressure path 321 for the sake of convenience of description.

As described above, the oil stored in the oil storage chamber V4 may be easily supplied to the compression chamber S1 through the first differential pressure path 311 and the second differential pressure path 321. In addition, as oil is easily supplied to the compression chamber S1, the same effects as that of the previously described embodiment, that is, reduction of wear, maintenance of the hermetic state, and dissipation of heat, for example, may be obtained using this embodiment.

Hereinafter, a structure for supplying oil of the scroll compressor of FIG. 1 according to still another embodiment will be described with reference to FIGS. 6 and 7.

Figure 6:
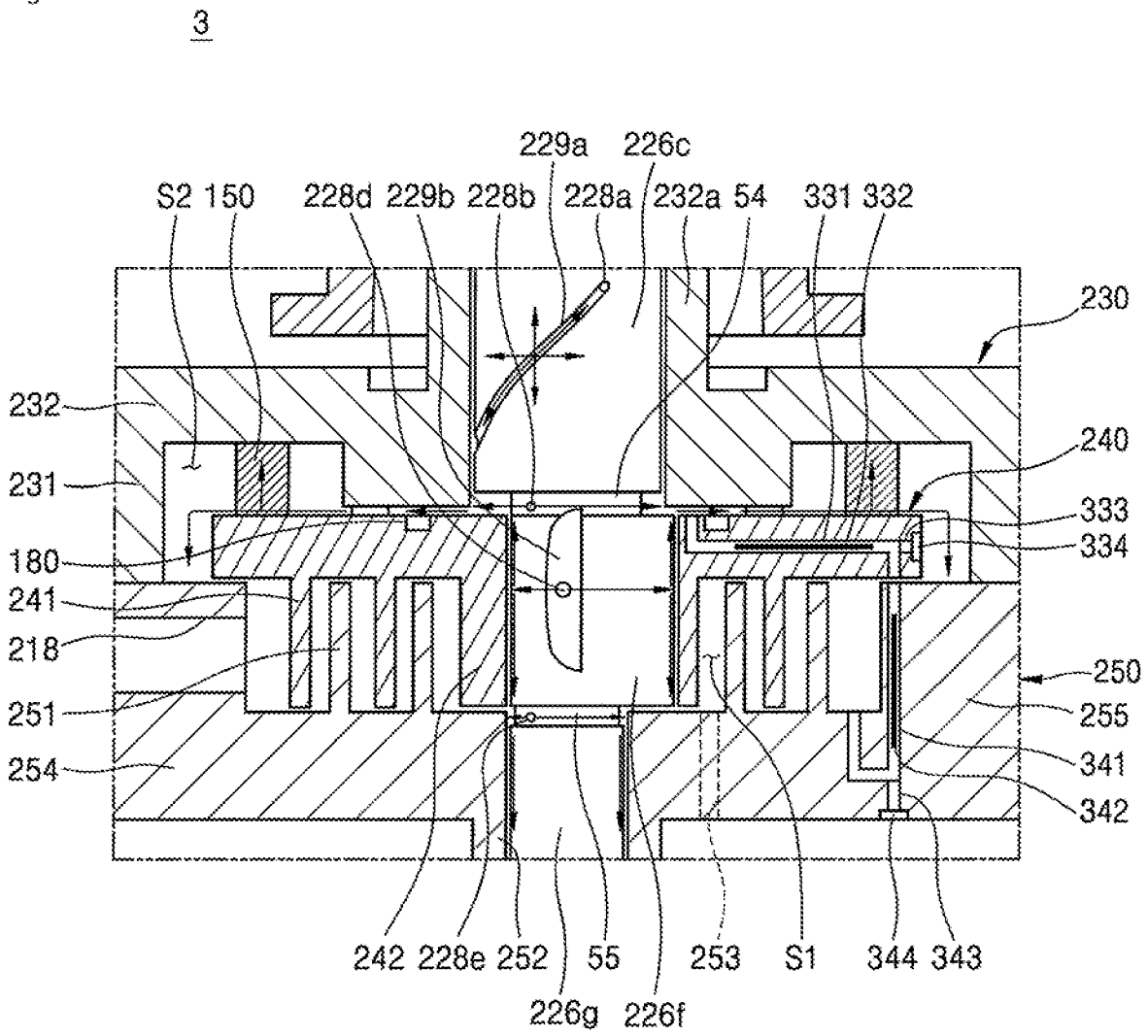
FIGS. 6 and 7 are schematic views of a structure for supplying oil of the scroll compressor of FIG. 1 according to still another embodiment.
Figure 7:
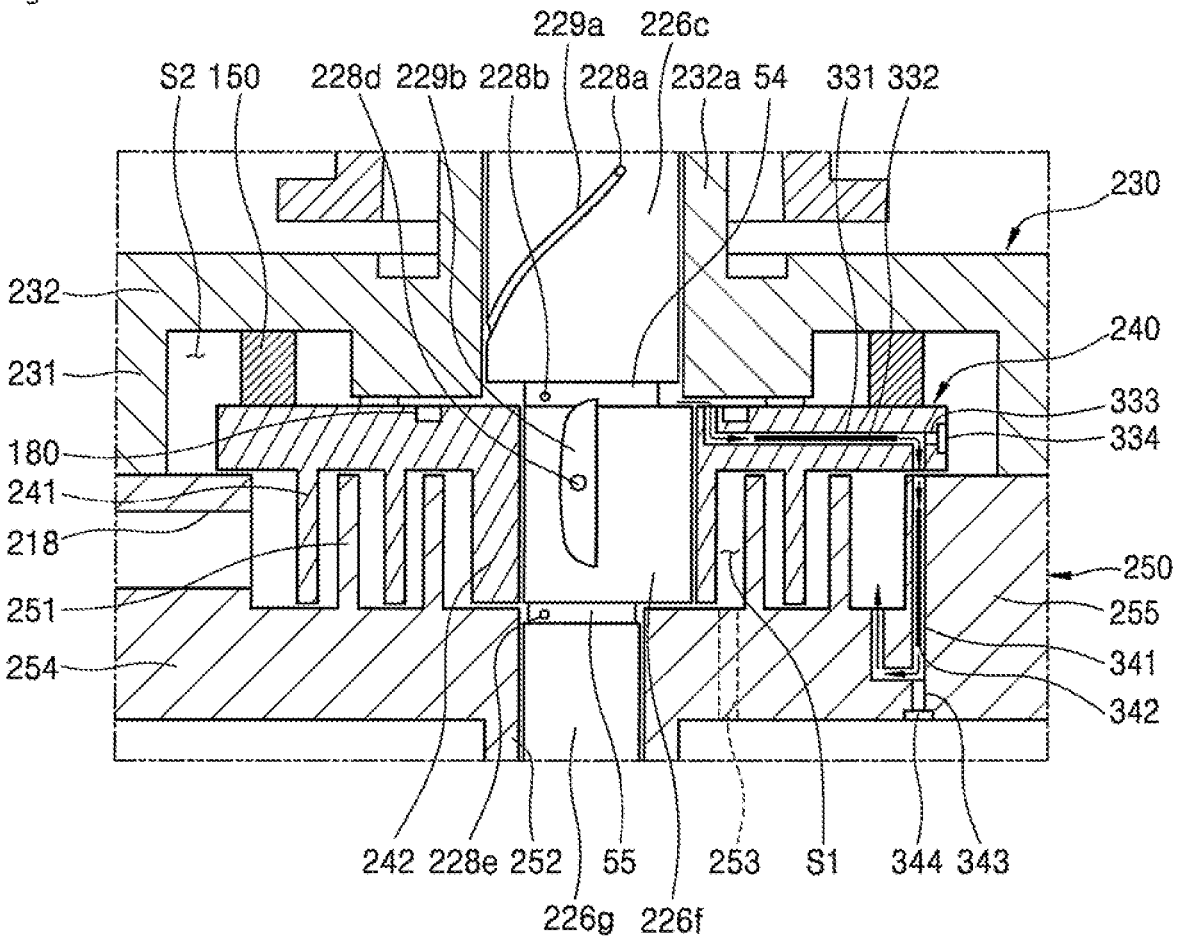

FIGS. 6 and 7 are schematic views of a structure for supplying oil of the scroll compressor of FIG. 1. An oil flow according to a centrifugation structure for supplying oil is illustrated in FIG. 6, and an oil flow according to a differential pressure structure for supplying oil is illustrated in FIG. 7. However, as the oil flow according to the centrifugation structure for supplying oil and the pocket groove 180 illustrated in FIG. 6 may be the same as that of the embodiment illustrated in FIG. 2, repetitive description thereof has been omitted.

The orbiting scroll 240 of the scroll compressor of FIG. 1 may further include a first differential pressure path 331 configured to receive oil discharged through an oil hole, for example, the second oil hole 228*b*. Oil discharged through the second oil hole 228*b* and the first oil hole 228*a* or the third oil hole 228*d* may also be supplied to the first differential pressure path 331.

The first differential pressure path 331 may pass through the third end plate 245. In this way, one or a first end of the first differential pressure path 331 may be connected to a high pressure region to receive oil and the other or a second end of the first differential pressure path 331 may be connected to one or a first end of a second differential pressure path 341. The high pressure region may refer to a region between the first small diameter portion 54 and the first end of the first differential pressure path 331.

The fixed scroll 250 may further include the second differential pressure path 341 to guide oil provided from the first differential pressure path 331 to the compression chamber S1. The second differential pressure path 341 may pass through the second sidewall 255 and the second end plate 254.

In this way, the first end of the second differential pressure path 341 may be connected to the second end of the first differential pressure path 331 and the other or a second end of the second differential pressure path 341 may be connected to the compression chamber S1. However, some oil discharged through the second end of the first differential pressure path 331 may be supplied to the second differential pressure path 341 by the orbiting movement of the orbiting scroll 240, and some of the remaining oil may be supplied to the thrust surface of the fixed scroll 250.

The orbiting scroll 240 may further include a first opening 334, which opens a portion of the first differential pressure path 331 at a side surface of the third end plate 245, and a first coupling member 333, which seals the first opening 334. The fixed scroll 250 may further include a second opening 344, which opens a portion of the second differential pressure path 341 at a lower surface of the second end plate 254, and a second coupling member 343, which seals the second opening 344. Each of the first coupling member 333 and the second coupling member 343 may be one of, for example, a bolt (when a fastening method is applied), a rod (when a press-fitting method is applied), and a ball (when a press-fitting method is applied); however, embodiments are not limited thereto.

The first opening 334 may be used to insert a first decompression pin 332 into the first differential pressure path 331, and the second opening 344 may be used to insert a second decompression pin 342 into the second differential pressure path 341. When the first and second decompression pins 332 and 342 are respectively inserted into the first and second differential pressure paths 331 and 341, the first and second coupling members 333 and 343 may be respectively coupled to the first and second openings 334 and 344. That is, as the first coupling member 333 and the second coupling member 343 are respectively coupled to the first opening 334 and the second opening 344, pressures in the first differential pressure path 331 and the second differential pressure path 341 may be maintained.

In addition, the first decompression pin 332 may be provided in the first differential pressure path 331, and the second decompression pin 342 may be provided in the second differential pressure path 341. A diameter of the first decompression pin 332 may be smaller than a diameter of the first differential pressure path 331, and a diameter of the second decompression pin 342 may be smaller than a diameter of the second differential pressure path 341.

In this way, the first decompression pin 332 may form a narrow path in the first differential pressure path 331 through which oil may flow such that a pressure and a flow rate of oil in the first differential pressure path 331 may be adjusted. In addition, the second decompression pin 342 may form a narrow path in the second differential pressure path 341 through which oil may flow such that a pressure and a flow rate of oil in the second differential pressure path 341 may be adjusted.

A decompression pin may also be provided in only one of the first differential pressure path 331 or the second differential pressure path 341. However, in this embodiment, a decompression pin is shown as being provided in each of the first differential pressure path 331 and the second differential pressure path 341 for sake of convenience of description.

As described above, the oil stored in the oil storage chamber V4 may be easily supplied to the compression chamber S1 through the first differential pressure path 331 and the second differential pressure path 341. In addition, as oil is easily supplied to the compression chamber S1, the same effect as that of the previously described embodiment, that is, reduction of wear, maintenance of the hermetic state, and dissipation of heat, for example, may be obtained using this embodiment.

As described above, in the scroll compressor according to embodiments, as the oil stored in the oil storage chamber V4 may be easily supplied to the bearing portion, particularly, the bearing surface, through the centrifugation structure based on the rotary shaft 226, wear of the bearing portion may be prevented. In addition, as the wear of the bearing portion is prevented, reliability of the bearing portion may be secured.

In addition, in the scroll compressor according embodiments, as the oil stored in the oil storage chamber V4 may be easily supplied to the compression chamber S1 through various differential pressure structures, wear due to friction between the orbiting scroll 240 and the fixed scroll 250 may be reduced such that compression efficiency may be improved.

In addition, in the scroll compressor according to embodiments, an oil film may be formed between the fixed scroll 250 and the orbiting scroll 240 using the centrifugation structure and the differential pressure structure, the hermetic state may be maintained, and a frictional heat generated by a friction portion may also be absorbed to dissipate heat from the high temperature compression device 200.

As described above, in a scroll compressor according to embodiments, as oil stored in an oil storage chamber may be easily supplied to a bearing portion using a centrifugation structure using a rotary shaft, wear of the bearing portion may be prevented. In addition, as the wear of the bearing portion is prevented, reliability of the bearing portion may be secured.

Further, in a scroll compressor according to embodiments, oil stored in a storage chamber may be easily supplied to a compression chamber through various differential pressure structures, wear due to friction between an orbiting scroll and a fixed scroll may be reduced, and compression efficiency improved.

Embodiments disclosed herein are directed to a scroll compressor capable of smoothly supplying oil stored in an oil storage chamber to a bearing portion through a centrifugation structure using a rotary shaft. Embodiments disclosed herein are also directed to a scroll compressor capable of smoothly supplying oil stored in an oil storage chamber to a compression room through one of various differential pressure structures.

According to embodiments disclosed herein, a scroll compressor is provided that may include an oil supply path configured to guide oil stored in an oil storage chamber of a casing upward, and an oil hole configured to pass from the oil supply path to an outer circumferential surface of a rotary shaft so that the oil may be easily supplied to a bearing portion.

In addition, according embodiments disclosed herein, a scroll compressor is provided that may include a differential pressure structure for supplying oil in which a medium pressure chamber communicates with a compression chamber through a differential pressure path for supplying oil, or a differential pressure structure for supplying oil including a differential pressure path for supplying oil so that oil may bypass the medium pressure chamber and be supplied to the compression chamber such that the oil may be easily supplied to the compression chamber.

Objects are not limited to the described objects, and other objects and advantages may be understood by the descriptions and may be clearly understood by embodiments. In addition, it may be easily understood that the objects and the advantages may be made using elements and combinations thereof described in the appended claims.

This application relates to U.S. application Ser. No. 15/830,161, U.S. application Ser. No. 15/830,184, U.S. application Ser. No. 15/830,222, U.S. application Ser. No. 15/830,248, and U.S. application Ser. No. 15/830,290, all filed on Dec. 4, 2017, which are hereby incorporated by reference in their entirety. Further, one of ordinary skill in the art will recognize that features disclosed in these above-noted applications may be combined in any combination with features disclosed herein.

While embodiments has been described for those skilled in the art, it should be understood that the embodiments may be replaced, modified, and changed without departing from the technical spirit, and thus, embodiments not limited to the described embodiments and the accompanying drawings.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A compressor, comprising:

a casing having a refrigerant discharge pipe through which refrigerant is discharged and an oil storage space in which oil is stored;

a drive motor provided in an inner space of the casing;

a rotational shaft coupled to the drive motor to supply the oil;

an orbiting scroll that is coupled to the rotational shaft and configured to perform an orbital movement based on rotation of the rotational shaft;

a fixed scroll provided in engagement with the orbiting scroll to receive the refrigerant and compress and discharge the refrigerant; and a main frame provided to be seated on the fixed scroll to accommodate the orbiting scroll, wherein the drive motor is disposed between the refrigerant discharge pipe and the main frame, wherein the rotational shaft completely penetrates the main frame and the orbiting scroll and extends from the drive motor to the oil storage space, wherein the rotational shaft includes an oil passage through which the oil moves, and an oil hole that communicates with the oil passage through an outer circumferential surface of the rotational shaft, wherein the fixed scroll includes a differential pressure oil supply path that guides oil discharged from the oil hole into an area between the orbiting scroll and the fixed scroll, and wherein the orbiting scroll includes an orbiting differential pressure path that guides oil supplied from the oil hole to an inlet of the differential pressure oil supply path.

2. The compressor according to claim 1, wherein the fixed scroll includes a fixed scroll end plate that provides a space in which the refrigerant is compressed, and a fixed scroll sidewall that extends from the fixed scroll end plate to be seated on the main frame and accommodates the orbiting scroll, and wherein the differential pressure oil supply path penetrates the fixed scroll sidewall and the fixed scroll end plate.

3. The compressor according to claim 2, wherein the fixed scroll includes a discharge hole that penetrates the fixed scroll end plate and discharges the refrigerant, and wherein an outlet through which the oil is discharged from the differential pressure oil supply path is spaced apart from both the inner circumferential surface of the fixed scroll sidewall and the discharge hole.

4. The compressor according to claim 2, wherein the compressor further comprises a pin inserted into the differential pressure oil supply path.

5. The compressor according to claim 2, wherein an inlet of the differential pressure oil supply path is disposed between an outer circumferential surface of the orbiting scroll and an outer circumferential surface of the fixed scroll sidewall.

6. The compressor according to claim 5, wherein the inlet is disposed between the outer circumferential surface of the orbiting scroll and an inner circumferential surface of the main frame.

7. The compressor according to claim 2, wherein the main frame includes a main differential pressure path that guides oil supplied from the oil hole to the differential pressure oil supply path.

8. The compressor according to claim 7, wherein the main frame includes a main bearing section through which the rotational shaft passes, a main end plate that extends from the main bearing section, and a main sidewall that extends from the main end plate to be in contact with the fixed scroll sidewall, and wherein the main differential pressure path penetrates the main bearing section, the main end plate, and the main side wall.

9. The compressor according to claim 8, wherein an inlet of the differential pressure oil supply path is disposed between an inner circumferential surface of the fixed scroll sidewall and an outer circumferential surface of the fixed scroll sidewall.

10. The compressor according to claim 7, wherein the compressor further comprises a pin inserted into the main differential pressure path.

11. The compressor according to claim 1, wherein the orbiting scroll includes a hole that penetrates one surface of the orbiting scroll facing the main frame to communicate with the orbiting differential pressure path.

12. The compressor according to claim 11, wherein the compressor further comprises a pin inserted into the orbiting differential pressure path.

13. The compressor according to claim 1, wherein the orbiting scroll includes an opening that provides communication between the orbiting differential pressure path and the differential pressure oil supply path.

14. The compressor according to claim 1, wherein the orbiting scroll includes an orbiting bearing section through which the rotational shaft passes, wherein the main frame includes a main bearing section through which the rotational shaft passes, wherein the oil hole is disposed on at least one of an inner circumferential surface of the orbiting bearing section, an inner circumferential surface of the main bearing section, or a region corresponding to the orbiting bearing section and the main bearing section.

15. A compressor, comprising:

a casing having a refrigerant discharge pipe through which refrigerant is discharged and an oil storage space in which oil is stored;

a drive motor provided in an inner space of the casing;

a rotational shaft coupled to the drive motor to supply the oil;

an orbiting scroll that is coupled to the rotational shaft and configured to perform an orbital movement based on rotation of the rotational shaft;

a fixed scroll provided in engagement with the orbiting scroll to receive the refrigerant and compress and discharge the refrigerant; and a main frame provided to be seated on the fixed scroll to accommodate the orbiting scroll, wherein the drive motor is disposed between the refrigerant discharge pipe and the main frame, wherein the rotational shaft completely penetrates the main frame and the orbiting scroll and extends from the drive motor to the oil storage space, wherein the rotational shaft includes an oil passage through which the oil moves, and an oil hole that communicates with the oil passage through an outer circumferential surface of the rotational shaft, wherein the fixed scroll includes a differential pressure oil supply path that guides oil discharged from the oil hole into an area between the orbiting scroll and the fixed scroll, wherein the fixed scroll includes a fixed scroll end plate that provides a space in which the refrigerant is compressed, and a fixed scroll sidewall that extends from the fixed scroll end plate to be seated on the main frame and accommodates the orbiting scroll, wherein the differential pressure oil supply path penetrates the fixed scroll sidewall and the fixed scroll end plate, wherein an inlet of the differential pressure oil supply path is disposed between an outer circumferential surface of the orbiting scroll and an outer circumferential surface of the fixed scroll sidewall, and wherein the orbiting scroll includes an orbiting differential pressure path that guides oil supplied from the oil hole to the inlet of the differential pressure oil supply path.

16. The compressor according to claim 15, wherein the inlet is disposed between the outer circumferential surface of the orbiting scroll and an inner circumferential surface of the main frame.

17. A compressor, comprising:

a casing having a refrigerant discharge pipe through which refrigerant is discharged and an oil storage space in which oil is stored;

a drive motor provided in an inner space of the casing;

a rotational shaft coupled to the drive motor to supply the oil;

an orbiting scroll that is coupled to the rotational shaft and configured to perform an orbital movement based on rotation of the rotational shaft;

a fixed scroll provided in engagement with the orbiting scroll to receive the refrigerant and compress and discharge the refrigerant; and a main frame provided to be seated on the fixed scroll to accommodate the orbiting scroll, wherein the drive motor is disposed between the refrigerant discharge pipe and the main frame, wherein the rotational shaft completely penetrates the main frame and the orbiting scroll and extends from the drive motor to the storage oil space, wherein the rotational shaft includes an oil passage through which the oil moves, and an oil hole that communicates with the oil passage through an outer circumferential surface of the rotational shaft, wherein the fixed scroll includes a differential pressure oil supply path that guides oil discharged from the oil hole into an area between the orbiting scroll and the fixed scroll, wherein the fixed scroll includes a fixed scroll end plate that provides a space in which the refrigerant is compressed, and a fixed scroll sidewall that extends from the fixed scroll end plate to be seated on the main frame and accommodates the orbiting scroll, wherein the differential pressure oil supply path penetrates the fixed scroll sidewall and the fixed scroll end plates, wherein the orbiting scroll includes an orbiting differential pressure path that guides oil supplied from the oil hole to an inlet of the differential pressure oil supply path, and wherein the orbiting scroll includes a hole provided that penetrates one surface of the orbiting scroll facing the main frame to communicate with the orbiting differential pressure path or an opening that provides communication between the orbiting differential pressure path and the differential pressure oil supply path.

* * * * *